US008479476B2

(12) United States Patent
Baroncini

(10) Patent No.: US 8,479,476 B2
(45) Date of Patent: Jul. 9, 2013

(54) UNIT FOR SUPPLYING PRODUCTS

(75) Inventor: Ivano Baroncini, Castel San Pietro Terme (IT)

(73) Assignee: IMA SAFE S.r.l., Ozzano Emilia (Bologna)

( * ) Notice: Subject to any disclaimer, the term of this patent is extended or adjusted under 35 U.S.C. 154(b) by 289 days.

(21) Appl. No.: 12/919,182

(22) PCT Filed: Mar. 12, 2009

(86) PCT No.: PCT/EP2009/052909

§ 371 (c)(1),
(2), (4) Date: Aug. 24, 2010

(87) PCT Pub. No.: WO2009/115445

PCT Pub. Date: Sep. 24, 2009

(65) Prior Publication Data

US 2011/0030314 A1 Feb. 10, 2011

(30) Foreign Application Priority Data

Mar. 19, 2008 (EP) ..... 08425171

(51) Int. Cl.
*B65B 9/04* (2006.01)

(52) U.S. Cl.
USPC ..... 53/246; 53/254; 221/265; 221/233; 221/169; 221/203; 222/367

(58) Field of Classification Search
USPC ..... 53/246, 539, 254, 559, 561; 221/265, 221/233, 277, 203, 169, 68; 222/370, 367, 222/352
See application file for complete search history.

(56) References Cited

U.S. PATENT DOCUMENTS 806,032 A * 11/1905 Wertz et al. ..... 221/203
814,182 A * 3/1906 Anderson et al. ..... 221/235
964,782 A * 7/1910 Hull ..... 222/352
2,457,220 A * 12/1948 Fowler et al. ..... 222/352

(Continued)

FOREIGN PATENT DOCUMENTS

EP 0797525 A 10/1997

*Primary Examiner* — Alexandra Elve
*Assistant Examiner* — Andrew M Tecco
(74) *Attorney, Agent, or Firm* — William J. Sapone; Ware Fressola Maguire & Barber LLP

(57) ABSTRACT

The unit for supplying and inserting products (2) to and into container elements (3, 3A) advancing along a line of a packing machine (M) comprises a flat element (8) provided with a through-slit (10), and a disc (4) affording through-holes (6). The unit (1) is positionable with respect to the line of the packing machine (M) such that the slit (10) is arranged above the container elements (3, 3*a*). Products (2) are supplied onto the disc (4) which products (2) are to be inserted in the container elements (3, 3*a*), each through-hole (6) being of such a size as to be able to receive and house internally thereof a product (2). The disc (4) is mounted above the flat element (8) such that the products (2) housed in the through-holes (6) rest on the flat element (8). The disc (4) is also activatable in rotation with respect to the flat element (8), and with respect to the container elements (3, 3*a*) advancing long the line, in order to bring the products (2) received in the through-holes (6) above the slit (10), contemporaneously with a transit of the container elements (3, 3*a*) below the slit (10) such that the products (2) fall directly internally of the container elements (3, 3*a*).

14 Claims, 7 Drawing Sheets

U.S. PATENT DOCUMENTS 2,777,561 A * 1/1957 Rose ..... 198/393
2,801,025 A * 7/1957 Cookson et al. ..... 221/203
2,930,509 A * 3/1960 Hall ..... 221/265
3,281,012 A * 10/1966 Martell ..... 221/172
3,628,694 A * 12/1971 Nichols ..... 221/265
3,732,663 A * 5/1973 Geldmacher ..... 53/412
4,834,264 A * 5/1989 Siegel et al. ..... 221/200
5,450,710 A * 9/1995 Jensen et al. ..... 53/475
5,481,855 A 1/1996 Yuyama
5,802,804 A * 9/1998 Esposti et al. ..... 53/55
6,311,743 B1 11/2001 Baroncini
7,392,640 B2 * 7/2008 Vasquali ..... 53/498

* cited by examiner

FIG. 4
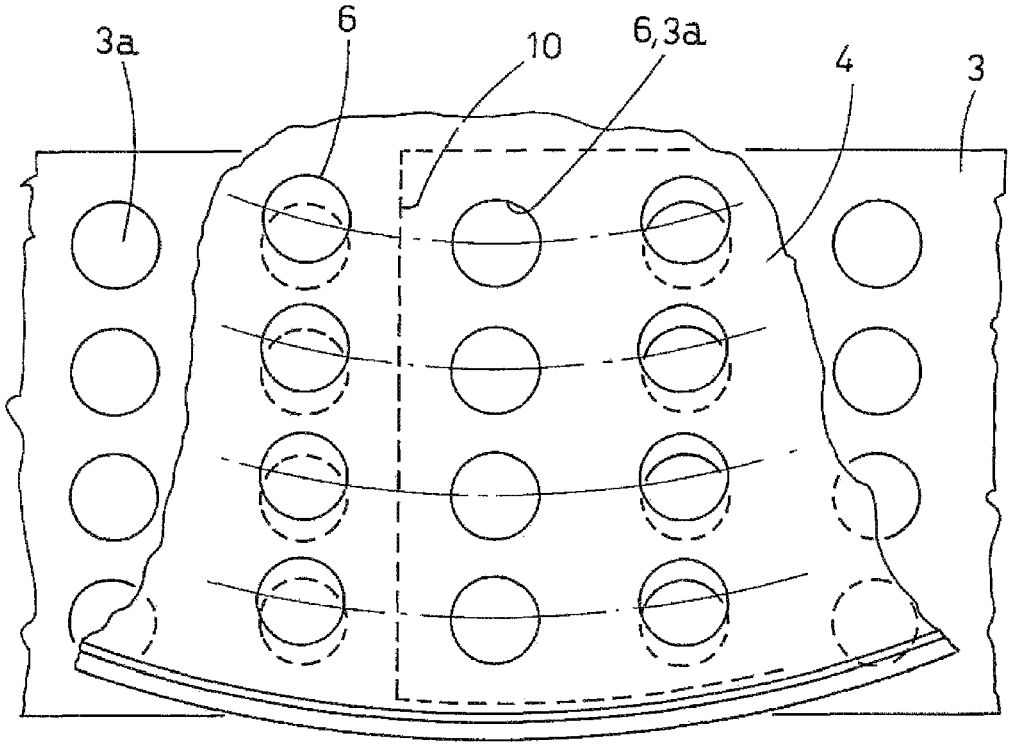
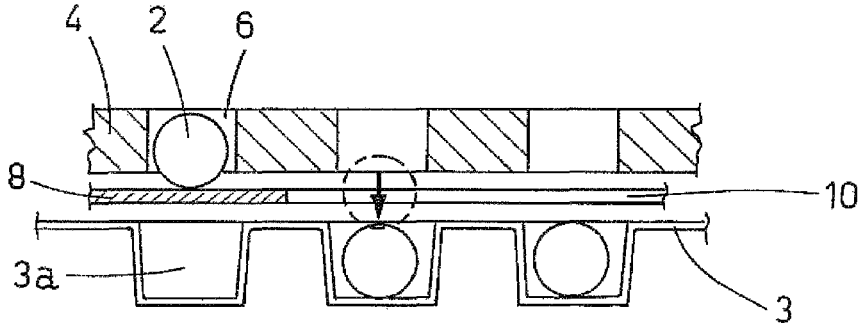
FIG. 5

UNIT FOR SUPPLYING PRODUCTS

FIELD OF THE INVENTION

The invention relates to a unit for supplying products, in particular pharmaceutical products.

In particular, the present invention is advantageously applied in supplying pharmaceutical products, preferably tablets or pills, to a blister-packing machine for realizing blister packs containing the products themselves, to which the following description will make explicit reference without the invention's losing in general application, or to a counter and packing machine which counts and inserts the products into containers such as bottles and the like.

BACKGROUND OF THE INVENTION

In general, a blister-packing machine of known type for realizing blister packs is of a type comprising a plurality of work stations arranged in a sequence, among which at least an unwinding station of a first strip made of a heat-formable material, for example plastic or aluminium, in which, by subsequent heat-welding, cells are formed to define a celled strip, a supply station in which a supply unit is destined to controlledly release the products to enable them to be housed in the cells of the celled strip which is advancing below the supply unit, a control station for checking the presence and integrity of the products themselves. Next is an unwinding station of a second strip of heat-weldable material, destined to be used for sealed closing of the celled strip with the cells filled with products, followed finally by a cutting station in which the formation of single blister packs obtained by means of sequential cutting of the celled strip filled with the products.

At present, one of the most critical points in blister machines of the above-described type occurs at the supply station at the stage of release of the products from a mass of products to go internally of the cells of the celled strip.

Although product supply and release units are known which operate optimally such that each cell is correctly filled with a relative product, such as for example the unit described and illustrated in EP patent EP 797,525 B1, or the unit described in U.S. Pat. No. 6,311,743, the operating efficiency of these supply units can considerably diminish, especially at high production speeds or when the celled strip advancing below the supply unit is very fast-moving.

Further, the supply units are often structurally complex and large, such as not to enable a rapid replacement thereof during change-format stages.

SUMMARY OF THE INVENTION

The aim of the present invention is to obviate the cited problems and drawbacks.

In particular, the aim of the present invention is to provide a supply unit of products to a packing machine which enables optimal supply of the products to be achieved at high production speeds.

According to the present invention, the supply unit of the products to a packing machine, where the packing machine comprises a line along which the container elements in which the products are to be inserted and packed are advanced in an advancement direction, is characterized in that it comprises:

a flat element provided with a through-slit, the unit being positionable with respect to the packing machine line such that the slit is arranged above the container elements advancing along the line;

a disc affording through-holes, onto which disc products are supplied which are to be inserted in the container elements, each through-hole of the through-holes being of such a size as to be able internally to receive and house a product, the disc being mounted above the flat element such that the products housed in the through-holes rest on the element, the disc being further activatable to rotate with respect to the flat element, and with respect to the container elements advancing along the line, in order to bring the products received in the through-holes above the slit at the same time as the transit of the container elements below the slit such that the products fall directly internally of the container elements.

Further advantageous characteristics of the present invention are set out in the dependent claims.

BRIEF DESCRIPTION OF THE DRAWINGS

The technical characteristics and advantages of the invention, according to the above-stated aims, clearly emerge from the following description, made with reference to the accompanying figures of the drawings, which illustrated preferred but non-limiting embodiments purely by way of example of the product supply unit, in which:

FIG. 3A is a partial section view of the disc and the flat element of the unit of the present invention in a first possible reciprocal configuration, while

FIG. 4 is a partial view from above of the relative arrangement between the holes in the disc and the container elements on the advancement line at the position of the slit of the flat element;

FIG. 5 is a partial view in transversal section of the arrangement illustrated in FIG. 4 in a case in which the container elements are constituted by a celled strip;

FIG. 6 is a partial view from above of a possible embodiment of the disc of the supply unit while

FIG. 8 shows, in a partial view from above, a further possible embodiment of the disc of the supply unit while

BEST MODES OF CARRYING OUT THE INVENTION

Figure 1:
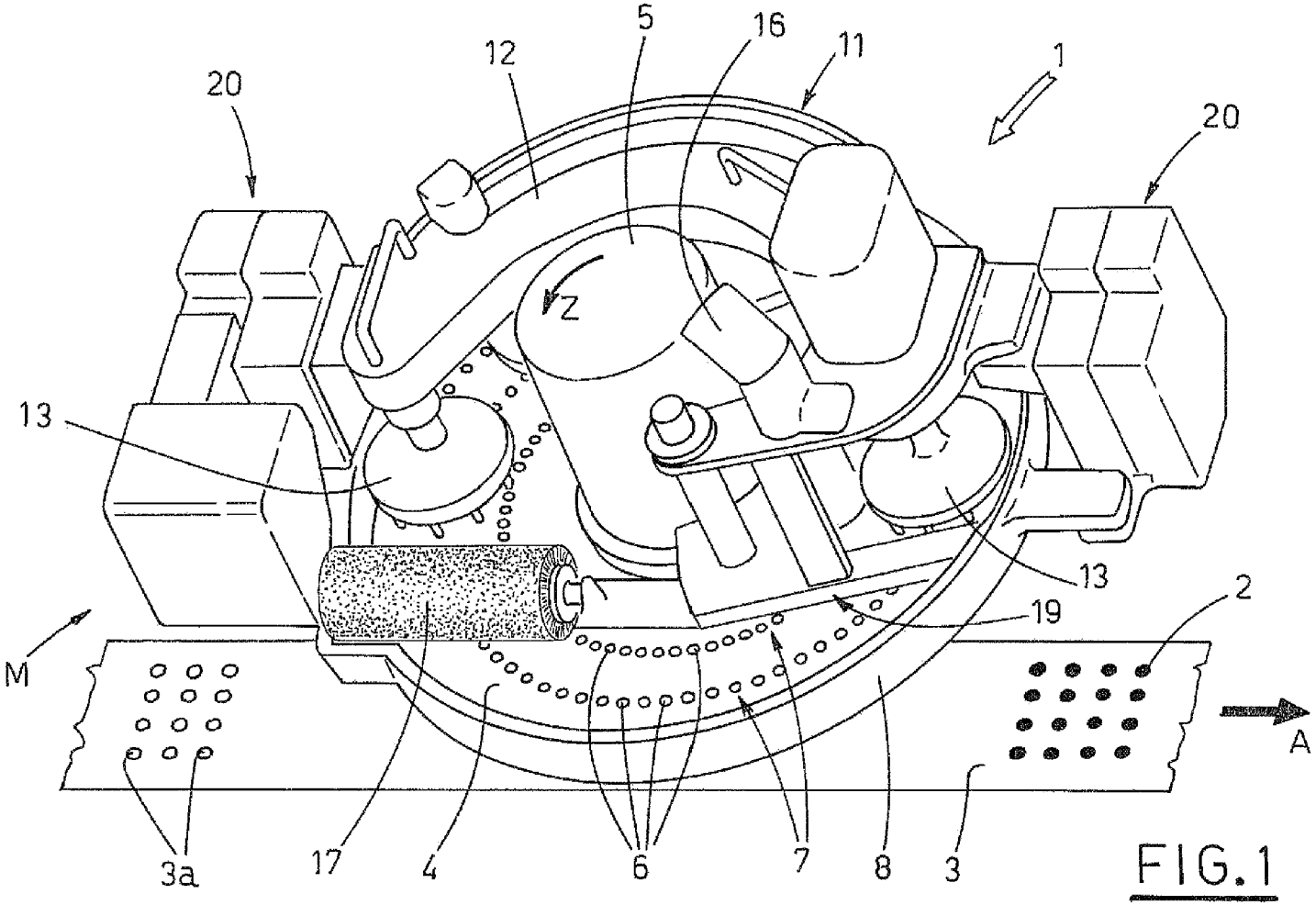
FIG. 1 is a schematic perspective view, partially sectioned and with some parts removed for reasons of clarity, of a first embodiment of the product supply unit of the present invention.
Figure 2:
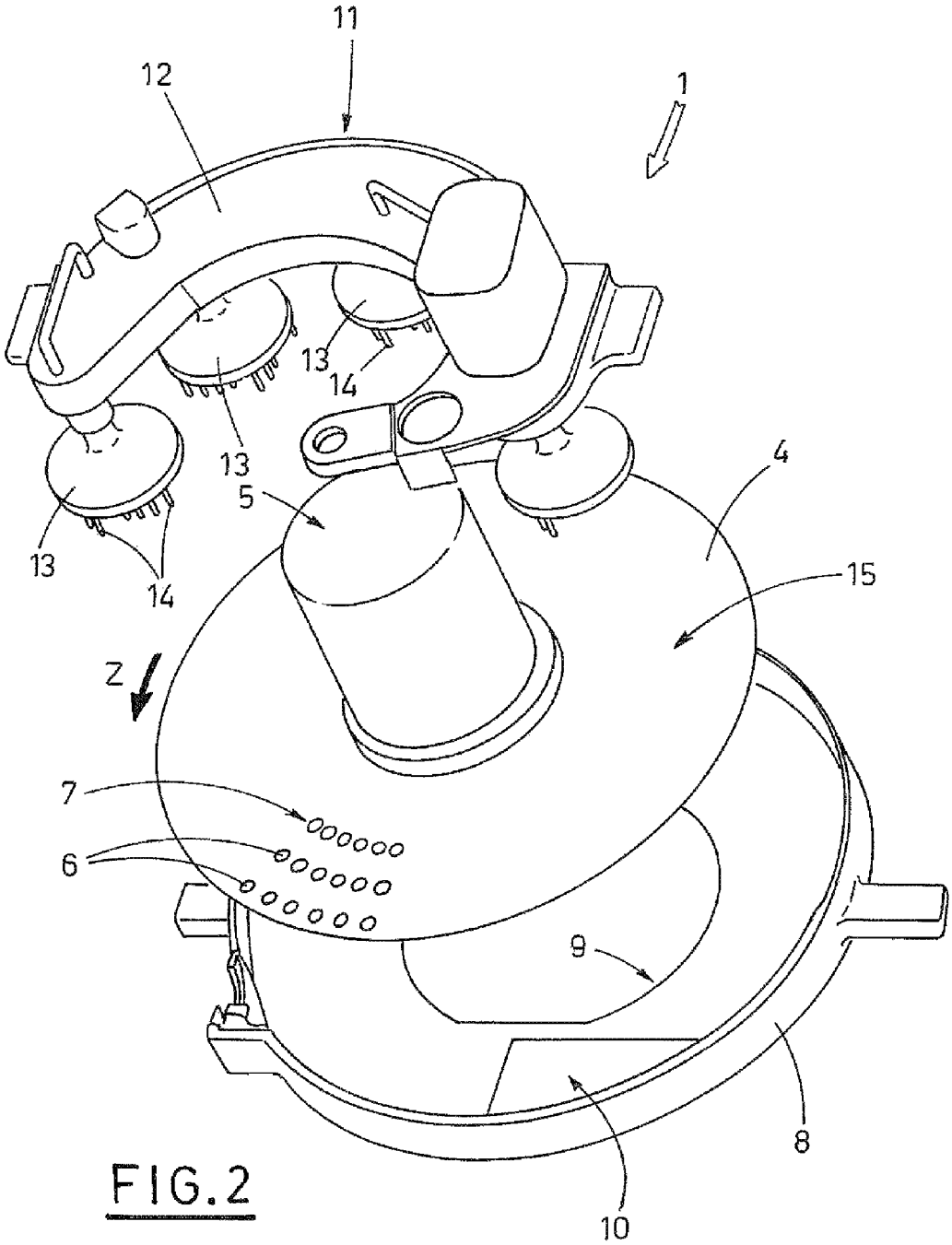
FIG. 2 is an exploded perspective view of structural elements making up the unit of FIG. 1.
Figure 3:
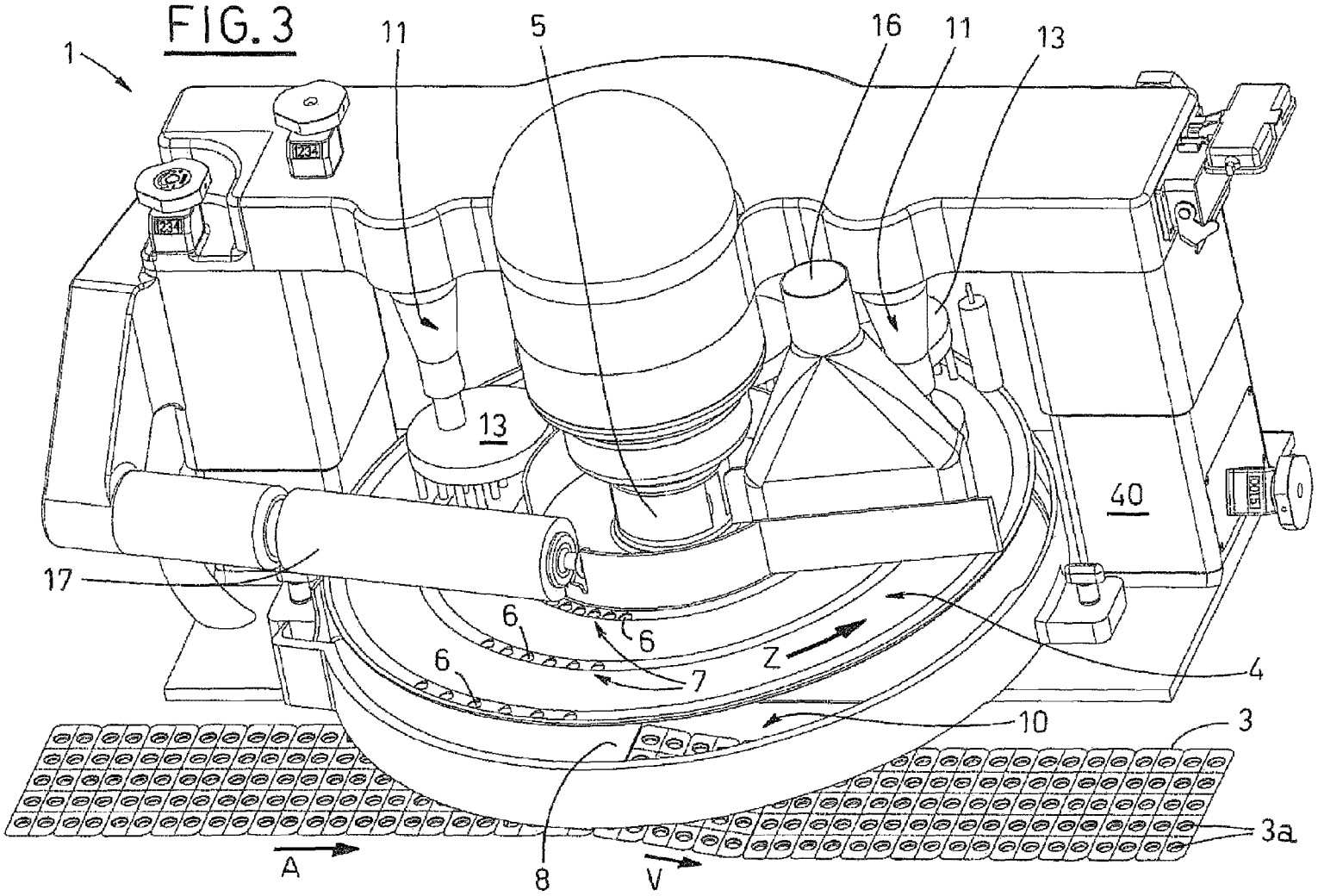
FIG. 3 is a schematic perspective view of a possible second embodiment of the product supply unit of the present invention.

With reference to the accompanying figures of the drawings, in particular FIGS. 1, 2 and 3, 1 denotes in its entirety a supply unit of pharmaceutical products 2, such as for example tablets and pills in general, preferably but not limited to an overall substantially cylindrical, spherical or rounded conformation.

The unit 1 constitutes an integral part of a packing machine M, for example a blister-packing machine M, or a counting machine M for filling bottles.

The packing machine M is provided with a line along which the container elements in which the pharmaceutical products 2 are to be inserted and packed are advanced in an advancement direction A.

In the case of a blister-packing machine the container elements are constituted by cells in the celled strip which will go to form the final blister pack, while in the other case they are directly constituted by the bottles.

In the following description, the machine M to which reference is made, while not losing in terms of general applicability, is a blister-packing machine (of known type) which supplies the products 2 towards a celled strip 3 with heat-formed cells 3*a*, which strip 3 is arranged immediately below the unit 1 and advances in a horizontal direction A via traction means for the strip 3 being a part of the machine M (of known type and not illustrated).

Figure 6:
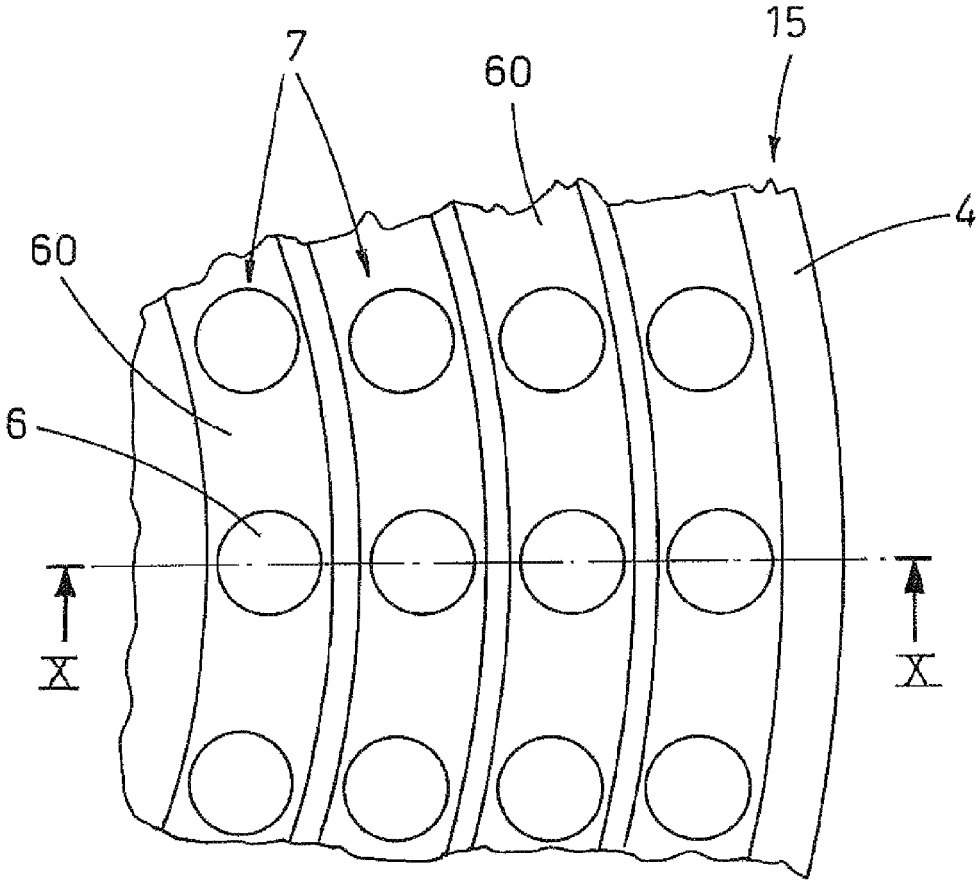
Figure 8:
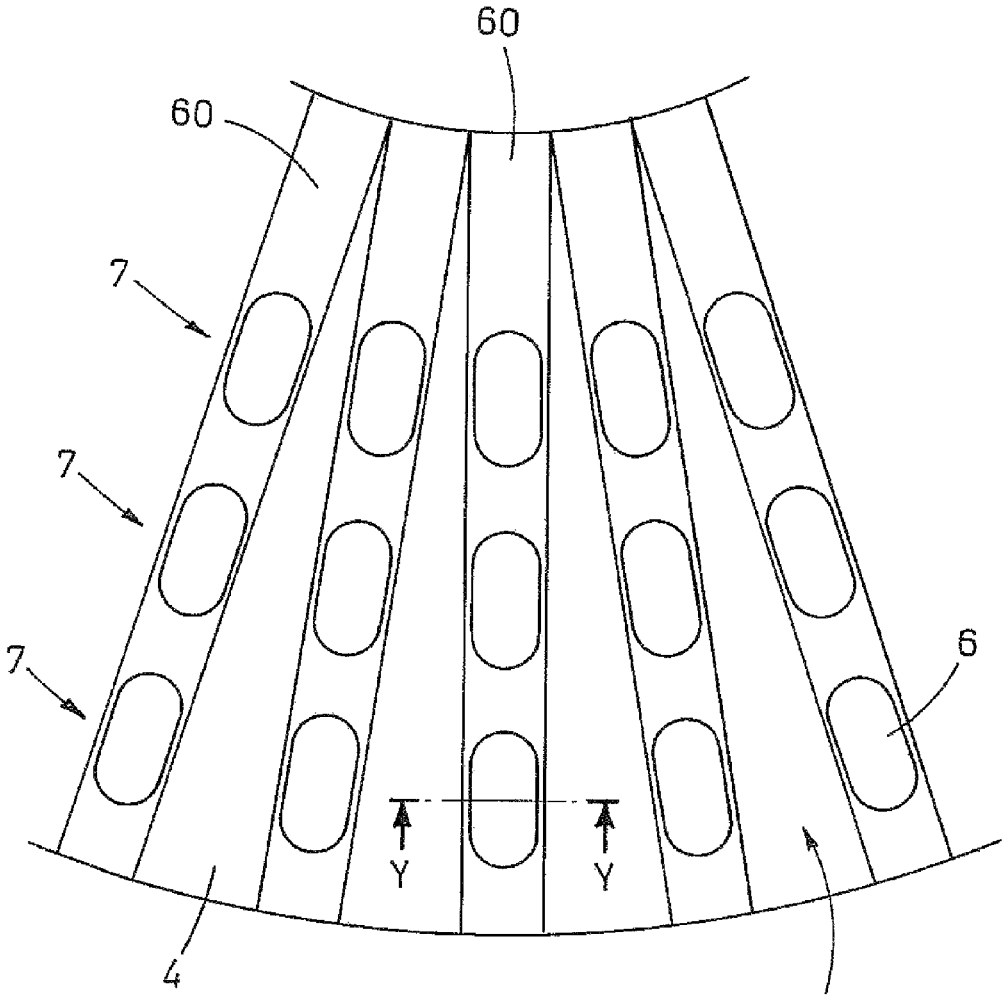

According to FIGS. 1 and 2, the unit 1 comprises a flat selector disc 4 which is destined to rotate (in an anti-clockwise direction Z, see FIGS. 1 and 3) powered by motor means 5 and provided on a flat surface thereof with a uniform distribution of circular through-holes 6, arranged on several circular and concentric rows 7 (of which only three are partially illustrated in FIGS. 2, 3, 8; of which only four are partially illustrated in FIG. 6).

The through-holes 6 are afforded in the disc 4 in concentric-circular rows 7 such that a radial distance between the various concentric circular rows corresponds to a distance between the container elements to be filled as they advance on the line of the packing machine M in direction A.

The disc 4 is destined to rotate, being mounted on and supported by a flat circular element 8 specially fixed to the structure of the machine M at a small predetermined distance above the strip 3 which advances in the horizontal direction A.

In particular, the flat element 8 is fixed to the structure of the machine M such as to be positioned in a horizontal plane above the horizontal advancement direction A of the strip 3.

The disc 4 is mounted above the flat element 8 in order to be, in turn, arranged in a respective horizontal plane, and is rotatable about the flat element 8 about a vertical axis.

Preferably, the disc 4 can also be activatable in rotary and vibration motion with respect to the flat element 8.

As is better illustrated in FIG. 2, the element 8 is without a central circular portion 9, and is therefore hollow, in order to enable assembly on the motion transmission means of the disc 4, and further exhibits a hollow through-slit 10 having a substantially triangular conformation.

The unit 1 further comprises a distributor group 11, in turn comprising a support element 12 having an annular portion, which is destined to support a uniformly-distributed plurality of rotating or oscillating brushes 13 having vertical axes and being provided with radial bristles 14 made of soft rubber or similar material and acting directly on the products 2.

The rotating brushes 13 are, in use, destined to give optimal and continuous dynamic distribution of the mass of the products 2 supplied continuously on the disc 4 via a conduit 16 (FIG. 1) which is a part of the unit 1, and thus to facilitate insertion of the products 2 internally of the circular holes 6 afforded on the selector disc 4.

The unit 1 further comprises a rotating brush 17 with a horizontal axis which further contributes to the insertion of the products 2 in the holes 6, eliminating excess quantities, which excess quantities are returned onto the disc 4 at the conduit 16 via a channel 19, and finally regulating and control means 20 of the position of various cited structural element, in particular the disc 4, of the group 11 and the relative brushes 13.

In a possible alternative embodiment illustrated in FIG. 3 the various structural element, such as the disc 4, the distribution group 11, with the relative brushes 13, 17 are borne by a frame 40 which is vertically mobile. This means the position of the disc 4 can be regulated and varied above the flat element 8, by adjusting its distance therefrom.

Figure 3A:
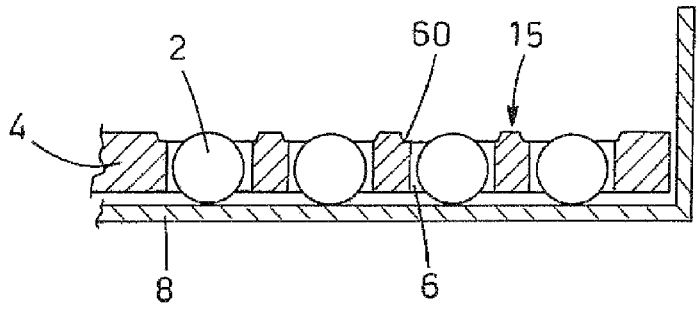
Figure 3B:
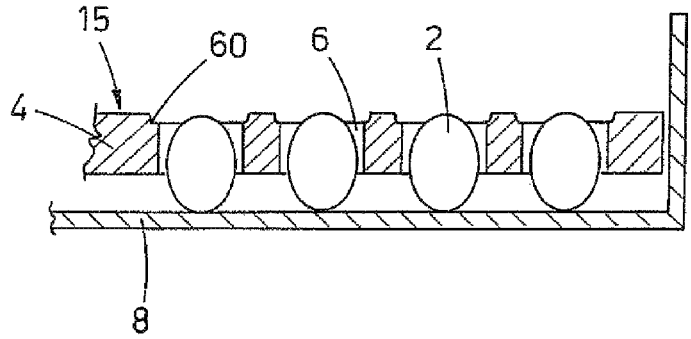
FIG. 3B illustrates, again in a partial section view, the same elements as in FIG. 3A in a further possible reciprocal configuration.

For example, as illustrated in more detail in FIGS. 3A and 3B, the distance between the disc 4 and the underlying flat element 8 can be varied and regulated in accordance with the various possible dimensions of the pharmaceutical products 2 to be transferred internally of the cells 3*a* of the celled strip 3.

In any case, the distance between the disc 4 and the flat element 8 is regulated such that the products 2 inserted in the through-holes 6 are always resting above the flat element 8 and preferably do not project beyond the upper surface 15 of the disc 4.

The regulation of the reciprocal distance between the disc 4 and the flat element 8 facilitates the distributing action of the products 2 by the brushes, in particular the horizontal-axis brush 17, which performs a sort of sweeping-clearing action of the excess products which accumulate on the disc 4 by the side of the holes 6, before the holes 6 internally having the products arrive at the position of the slit 10, through which the products will drop.

The possibility of varying the distance of the disc 4 from the flat element 8, in particular distancing the disc 4 from the flat element 8, offers the advantage, for example during a pause in the packing cycle, of creating sufficient space for performing the cleaning operation directly on the surface of the flat element 8; residual fragments can also be removed.

This constitutes an undeniable advantage, especially in a case of a change in the type of pharmaceutical products.

In further embodiment, the disc 4 can exhibit, on the relative upper surface 15 thereof, a series of grooves 60, in which the through-holes 6 are afforded, in order to facilitate transfer and fall of the products 2 from the upper surface 15 to inside the holes 6.

Figure 7:
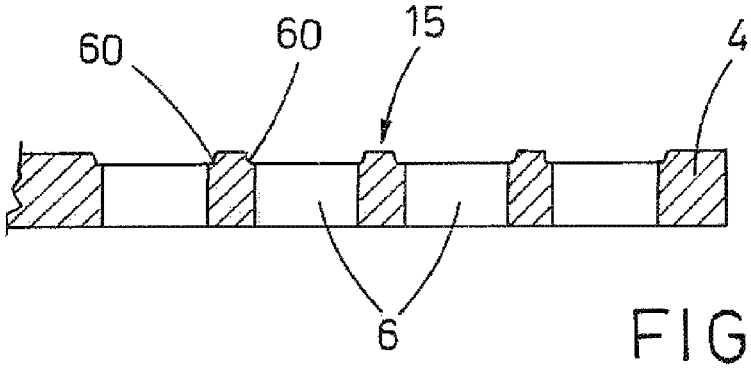
FIG. 7 represents a view according to section line X-X of FIG. 6.

For example, in a possible embodiment of the disc 4 illustrated in FIGS. 6 and 7, the grooves 60 are realized on the upper surface 15 of the disc 4 such as to exhibit a circular progression, and are reciprocally concentric.

Figure 9:
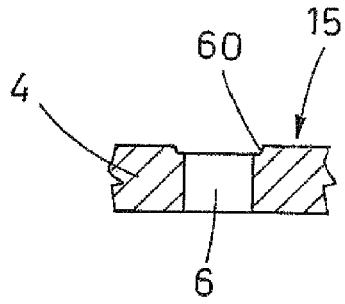
FIG. 9 is a view along section plane Y-Y of FIG. 8.

Further, in another possible embodiment of the disc 4 illustrated in FIGS. 8 and 9, the grooves 60 are realized on the upper surface 15 of the disc 4 such as to be radially arranged.

The thickness of the disc 4 and the vertical development of the through-holes 6 in the disc 4 are such that each through-hole 6 can freely receive and house single pharmaceutical products without constraint.

The through-holes 6 can exhibit a circular-shaped transversal section, i.e. oval, or corresponding to the shapes and dimensions of the pharmaceutical products.

In use, the products 2 supplied continuously by a hopper (not illustrated) onto the rotating disc 4 through the conduit 16 are distributed efficiently on the disc 4 by means of the brushes 13, which thus cause insertion of the products 2 into a relative seating defined by a hole 6 and at the bottom of the hole 6 by the flat element 8.

The vibratory motion by which the disc 4 can also be activated allows a better and faster insertion of the products 2 inside a relative hole 6.

With the progressive rotation of the disc 4, the products 2 in the holes 6 reach the hollow slit 10 and are no longer retained by the flat element 8 and fall onto the underlying celled strip 3, causing the insertion of the products 2 each in a relative cell 3*a* of the strip 3, without there being any possibility of exiting the cells 3*a*.

The motor means 5 rotate the disc 4 with respect to the flat element 8 and with respect to the celled strip 3 advancing along direction A, in order to guide the products 2 contained internally of the through-holes 6 to above the slit 10, contemporaneously with a transit of a row of cells 3*a* below the slit 10.

Figure 3C:
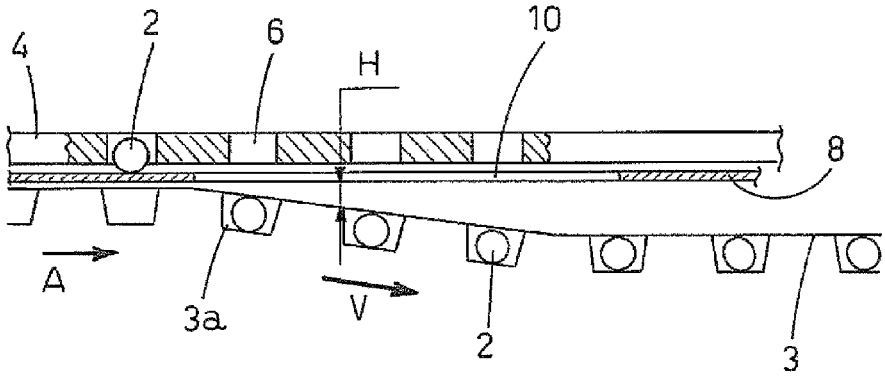
FIG. 3C is a partial section view of a preferred embodiment of the unit of the present invention in an advancement line of a celled strip of a blister-packing machine.

In the case of use of the unit 1 of the invention in a blister-packing machine M, in an advantageous variant illustrated in FIGS. 3 and 3*c*, the unit can be positionable with respect to the celled strip 3 such that between the flat element 8 and the celled strip 3 there is, at the position of the slit 10 for the fall of the products, a progressive split in level H, in the advancement direction of the strip 3, which facilitates the fall of the products into the cells 3*a*.

In particular the unit 1 can advantageously be positionable in the blister-packing machine M such that the slit 10 of the flat element 8 is above a region of transit of the advancement line of the celled strip 3 at a position in which the celled strip 3 passes from a horizontal advancement configuration A to an inclined advancement configuration V distancing from the flat element 8.

The invention offers the following advantages:

optimal and effective supply of products to a packing machine, including in high-speed production regimes, and thus of high-speed advancement of the celled strip;

great facility and rapidity of demounting of the structural components of the unit of the invention, with a consequent rapidity and facility of regulation during change-format operations;

possibility of replacing the unit with traditional supply units, contributing to making the packing machine even more versatile.

The invention claimed is:

1. A unit for supplying products (2) to a packing machine (M), the packing machine (M) comprising a line along which container elements (3, 3A) in which the products (2) are to be inserted and packed are advanced in an advancement direction (A), the unit (1) comprising:

a flat element (8) provided with a through-slit (10), arranged directly closely above and facing the container elements (3, 3*a*) advancing on the line;

a disc (4) having an upper surface and a lower surface and having through-holes (6), each through-hole sized for receiving and housing internally thereof a respective product (2), with a lower portion of the product extending below the lower surface thereof, a frame for bearing the disc and for adjustably positioning the disk with respect to the flat element (8), the lower surface of the disk (4) facing the flat element (8) and being spaced away from the flat element (8) for an adjustable distance such that the lower portions of the products (2) housed in the through-holes (6) rest on and are supported by the flat element (8) while upper portions of the products (2) are disposed below the upper surface of the disc (4), the frame being vertically movable with respect to the flat element (8) for adjusting the position of the disc (4) above the flat element (8), the space between the lower surface of the disc (4) and the flat element (8) being adjusted for receiving products (2) of different dimensions internally of the through-holes (6), such that more or less of the product lower portions are accommodated by the adjusted space, the disc (4) also being activatable in rotation with respect to the flat element (8), and with respect to the container elements (3, 3*a*) advancing along the line, in order to bring the products (2) housed in the through-holes (6) to a position above the slit (10) contemporaneously with a transit of the container elements (3, 3*a*) below said slit (10) such that the products (2) housed in the through-holes (6) fall directly through the slit (10) into the container elements (3, 3*a*).

2. The unit of claim 1, further comprising a product distributor for distributing the products (2) uniformly over the upper surface (15) of the disc (4) in order to facilitate insertion of the products (2) into said through-holes (6).

3. The unit of claim 2, wherein said product distributor has a support element (12), positioned above a portion of the upper surface (15) of the disc (4), for supporting a plurality of brushes (13) rotating or oscillating along a vertical axis, the brushes (13) being inferiorly provided with radial vertical bristles (14).

4. The unit of claim 2, wherein said product distributor has a support element (12), positioned above a portion of the upper surface (15) of the disc (4), for supporting at least one brush (17) rotatable or oscillating along a horizontal axis.

5. The unit of claim 1, wherein said through-holes (6) are arranged on said disc (4) in concentric circular rows (7), a distance between each row corresponding to a distance between the container elements (3, 3*a*) advancing along the direction (A).

6. The unit of claim 5, wherein the upper surface of the disk has a series of grooves (60), entrances to said through-holes (60) located within the grooves (60), the grooves (60) facilitating insertion of the products (2) into the through-holes (6).

7. The unit of claim 6, characterized in that the grooves (60) are radially arranged on the upper surface (15) of the disc (4).

8. The unit of claim 6, characterized in that the grooves (60) are arranged in a circular progression on the upper surface (15) of the disc (4).

9. The unit of claim 1, characterized in that said through-holes (6) exhibit a transversal section having a circular or oval shape.

10. The unit of claim 1, further comprising a motor (5) for rotating the disc (4).

11. The unit of claim 1 wherein the the container elements are cells of a celled strip (3) for forming blister-packs.

12. The unit of claim 11, wherein the slit (10) of the flat element (8) is above a region where the celled strip (3) passes from a horizontal advancement configuration (A) to an inclined advancement configuration (V) for distancing the celled strip away from the flat element (8) such that there is a progressive split in level (H) in the advancement direction of the strip (3).

13. The unit of claim 1 wherein the container elements are bottles.

14. The unit of claim 1 wherein the disc is activatable in vibration for promoting insertion of the products (2) into the through-holes (6).

* * * * *